United States Patent [19]

Yannes

[11] Patent Number: 4,677,890

[45] Date of Patent: Jul. 7, 1987

[54] SOUND INTERFACE CIRCUIT

[75] Inventor: Robert J. Yannes, Media, Pa.

[73] Assignee: Commodore Business Machines Inc., West Chester, Pa.

[21] Appl. No.: 455,974

[22] Filed: Feb. 27, 1983 (Under 37 CFR 1.47)

[51] Int. Cl.[4] ..... G10G 1/12; G10G 1/46

[52] U.S. Cl. ..... 84/1.19; 84/1.27; 84/DIG. 9

[58] Field of Search ..... 84/1.01, 1.19, 1.27, 84/DIG. 9

[56] References Cited

U.S. PATENT DOCUMENTS 4,377,960 3/1983 Okumura ..... 84/1.01
4,416,178 11/1983 Ishida ..... 84/1.19
4,453,439 6/1984 Koike ..... 84/1.01
4,479,411 10/1984 Ishibashi ..... 84/1.01

*Primary Examiner*—S. J. Witkowski
*Attorney, Agent, or Firm*—John J. Simkanich

[57] ABSTRACT

A sound interface circuit is implemented in large scale integrated circuitry (LSI) on a single chip to provide 3 voice electronic music synthesizer/sound effects, and is compatible with instructions from commercially available microprocessors; whereof a wide range, high-resolution control of pitch (frequency) tone color (harmonic content) and dynamics (volume) is achieved and specialized control circuitry minimizes software overhead, facilitating use in arcade/home video games and low cost musical instruments.

8 Claims, 18 Drawing Figures

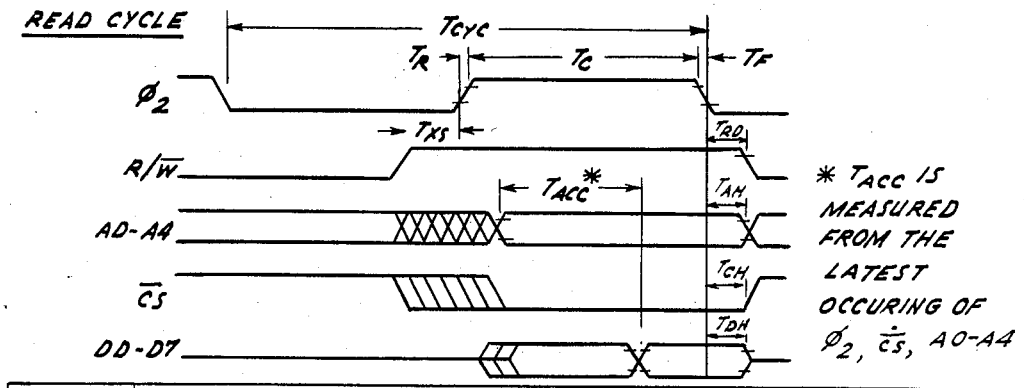

| SYMBOL | NAME | MIN | TYP | MAX | UNITS |
|---|---|---|---|---|---|
| Tcyc | CLOCK CYCLE TIME | 1 | — | 20 | US |
| Tc | CLOCK HIGH PULSE WIDTH | 450 | 500 | 10,000 | ns |
| Tr / Tf | CLOCK RISE/ FALL TIME | — | — | 25 | ns |
| Trs | READ SET-UP TIME | 0 | — | — | ns |
| Trh | READ HOLD TIME | 0 | — | — | ns |
| Tacc | RECESS TIME | — | — | 300 | ns |
| Tah | ADDRESS HOLD TIME | 10 | — | — | ns |
| Tch | CHIP SELECT HOLD TIME | 0 | — | — | ns |
| Tdh | DATA HOLD TIME | 20 | — | — | ns |

FIG. 3.

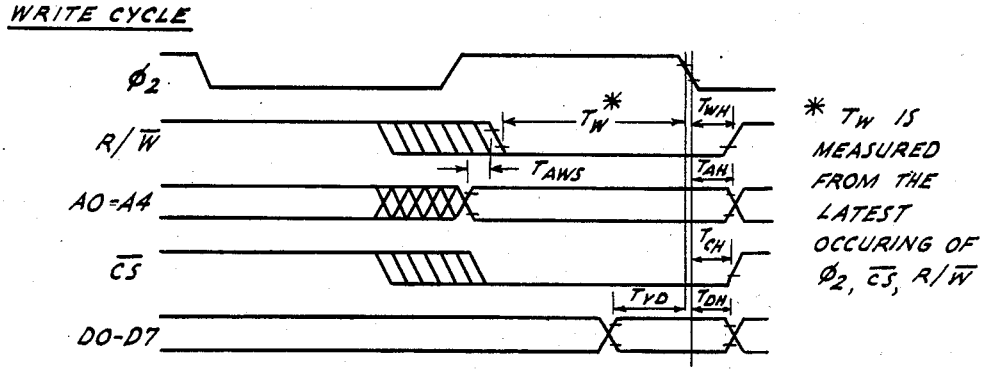

| SYMBOL | NAME | MIN | TYP | MAX | UNITS |
|---|---|---|---|---|---|
| Tw | WRITE PULSE WIDTH | 350 | — | — | nS |
| Twh | WRITE HOLD TIME | 0 | — | — | nS |
| Taws | ADDRESS SET-UP TIME | 0 | — | — | nS |
| Tah | ADDRESS HOLD TIME | 10 | — | — | nS |
| Tch | CHIP SELECT HOLD TIME | 0 | — | — | nS |
| Tvd | VALID DATE | 80 | — | — | nS |
| Tdh | DATA HOLD TIME | 10 | — | — | nS |

FIG. 4.

| | | |
|---|---|---|
| ATTACK: | 10 ($A) | 500 mS |
| DECAY: | 8 | 300 mS |
| SUSTAIN: | 10 ($A) | |
| RELEASE: | 9 | 750 mS |

| | | |
|---|---|---|
| ATTACK: | 0 | 2 mS |
| DECAY: | 9 | 750 mS |
| SUSTAIN: | 0 | |
| RELEASE: | 9 | 750 mS |

| | | |
|---|---|---|
| ATTACK: | 0 | 2 mS |
| DECAY: | 9 | 750 mS |
| SUSTAIN: | 0 | |
| RELEASE: | 0 | 6 mS |

| | | |
|---|---|---|
| ATTACK: | 0 | 2 mS |
| DECAY: | 0 | 6 mS |
| SUSTAIN: | 15 ($F) | |
| RELEASE: | 0 | 6 mS |

| | | |
|---|---|---|
| ATTACK: | 10 ($A) | 500 mS |
| DECAY: | 0 | 6 mS |
| SUSTAIN: | 15 ($F) | |
| RELEASE: | 3 | 72 mS |

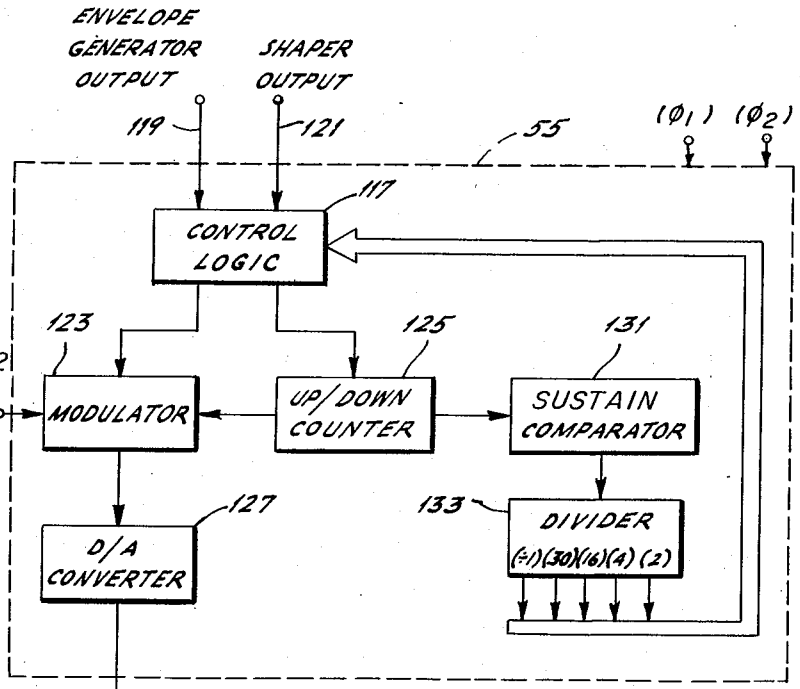
FIG. 10.
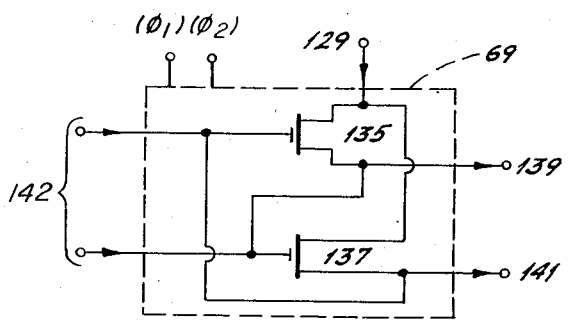
FIG. 11.
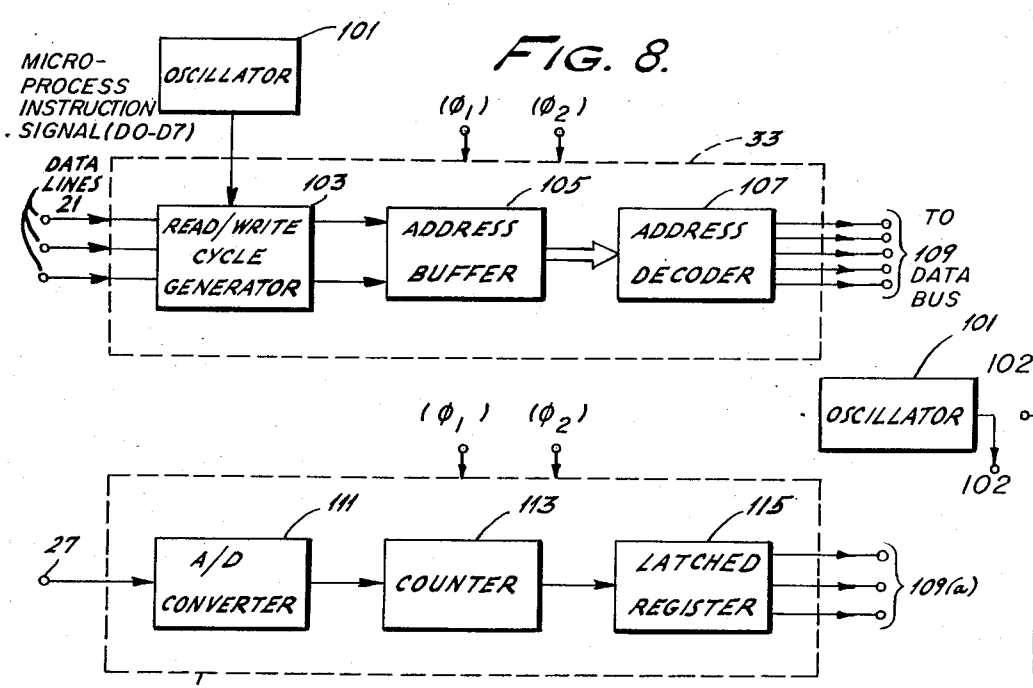
FIG. 8.
FIG. 9.

SOUND INTERFACE CIRCUIT

BACKGROUND OF THE INVENTION

The invenlion relates to sound synthesizer and sound effects generator circuits, and particularly to single chip implemented circuits compatible with discrete logic or LSI processors for generating sound effects and/or musical notes when used independently or with external audio sources.

An object of this invention is to provide a sound synthesizer circuit on a single LSI chip which is compatible with NMOS technology.

A second object of this invention is to provide such a circuit which is capable of generation of 3 separate tones with a frequency of 0 to 4 KHz.

A third object of this invention is to provide such a circuit which is capable of generating 4 waveforms from each of the 3 separate tone generators/oscillators.

Another object of this invention is to provide such a circuit with 3 amplitude modulators with a range of 48 dB.

Another object of this invention is to provide such a circuit with 3 envelope generators capable of exponential responses for "attack rate" of 2 ms to 8 s, for "decay rate" of 6 ms. to 24 s, for "sustain level" of 0 to peak volume, and for "release rate" of 6 ms to 24 s.

A further object of this invention is to provide such a circuit with ring modulation, oscillator synchronization and programmable filter capabilities.

SUMMARY OF THE INVENTION

The objects of this invention are realized in an LSI, NMOS implemented three "voice" synthesizer circuit which is interfaced between a sound instruction source and a sound production element, which synthesizer generates the electronic signals needed to drive the sound production element.

The invention generates or synthesizes 3 "voices" which can be used independently or in conjunction with each other (or external audio sources) to create complex sounds. Each voice is provided by a tone Oscillator/-Waveform Generator, an Envelope Generator and an Amplitude Modulator. The Tone Oscillator controls the pitch of the voice over a wide range. The Oscillator produces four waveforms at the selected frequency, with the unique harmonic content of each waveform providing simple control of tone "color". The volume dynamics of the oscillator are controlled by the Amplitude Modulator under the direction of the Envelope Generator. When triggered, the Envelope Generator creates an amplitude envelope with programmable rates of increasing and decreasing volume. In addition to the three voices, a programmable filter is provided for generating complex, dynamic tone colors via substractive synthesis.

A microprocessor reads the changing output of the third Oscillator and third Envelope Generator. These outputs can be used as a source of modulation information for creating vibrato, frequency/filter sweeps and similar effects. The third oscillator can also act as a random number generator for games. Two A/D converters are provided for interfacing with potentiometers. These can be used for "paddles" in a game environment or as a front panel controls in a music synthesizer. External audio signals can be processed, thereby allowing duplicate circuits of the invention to be daisy-chained or mixed in complex polyphonic systems.

DESCRIPTION OF THE DRAWINGS

The features, operation and advantages of this invention will be readily understood from a reading of the following detailed description of the invention with the accompanying drawings in which like numerals refer to like elements and in which:

FIG. 3 is a timing diagram for the "read cycle" of the circuit of the invention.

FIG. 4 is a timing diagram for the "write cycle" of the circuit of the invention.

FIG. 8 is a detailed block circuit diagram for the data buffers 33 of FIG. 2.

FIG. 9 is a detailed block circuit diagram for the potentiometer interface 39 of FIG. 2.

FIG. 10 is a detailed block circuit diagram for the modulator 55 of FIG. 2.

FIG. 11 is a circuit diagram for the switch 69 of FIG. 2

DETAILED DESCRIPTION OF THE INVENTION

A sound interface circuit is provided by a programmably adjustable 3 voice (i.e. tone) sound frequency synthesizer (i.e. generator) whose frequency range, waveform and wave characteristics (i.e. ramp to a peak or "attack rate", fall off or "decay rate" to a sustain level, steady state "note" frequency or "sustain level" and fall off to zero or "release rate") are programmably selectable.

The synthesizer is provided on a single-chip in a LSI (large scale integration) circuit using NMOS technology and is information compatible with commercially available microprocessors such as the Commodore 6505. A wide range of frequencies, high resolution control of pitch, tone color (harmonic content) and dynamics (volume) is possible. Control circuitry minimizes the software instructions needed.

Figure 1:
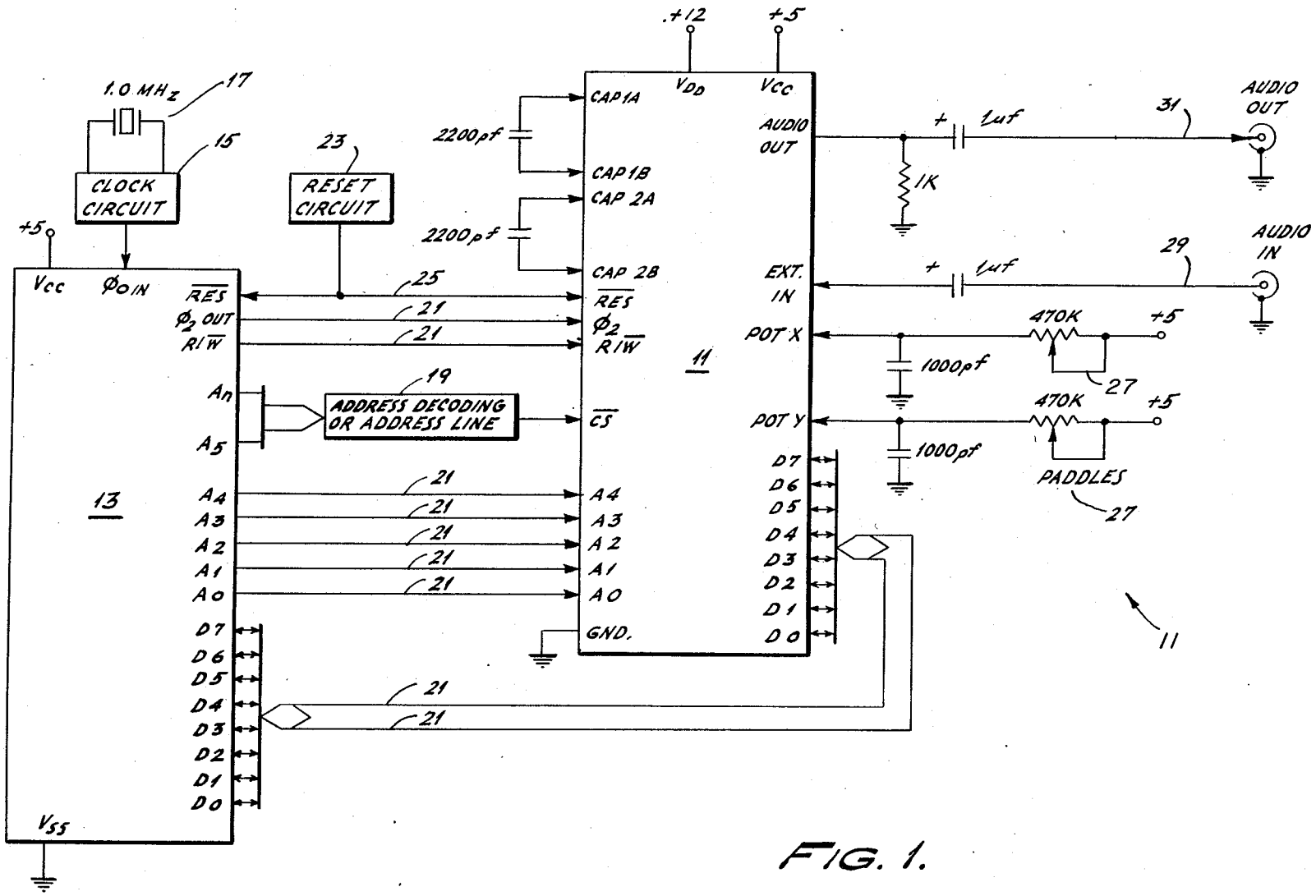
FIG. 1 is a block circuit diagram of the system environment application of the invention.

A typical application for the invention shown in FIG. 1; here the sound interface circuit invention 11 is utilized in conjunction with a microprocessor 13 in a arcade/home video game device or in a low cost musical instrument. The microprocessor 13 receives clock pulses from a clock circuit 15 which is driven by a 1 MHz oscillator 17. The microprocessor 13 provides address decoding or address line information 19 to the sound interface circuit 11. Microprocessor 13 also provides program instructions to specify the frequency for each of the 3 tone oscillators within the sound interface circuit 11, as well as the waveform for each oscillator, this waveform being selectable from the class of triangular waves, soft tooth waves, variable pulse (i.e. square waves) or noise (white noise). Each of the three oscillators resident in the sound interface circuit 11 may be instructed to generate one of the selected wave forms or each oscillator generate the same waveform of different frequency and envelope. The microprocessor 13 also provides program instructions to three amplitude modulators within the sound interface circuit to instruct each as to the "volume" output. Three envelope generators also receive programmable instructions as to attack rate, decay rate, sustain rate, and release rate.

The sound interface circuit 11 also contains a programmable filter whose "notch" is adjustable as well as its resonance, as well as cut-off range and roll-off. This programmable filter receives instructions from the microprocessor 13.

The programmable filter also has a low pass, band pass, and high pass filter sections which are selectably operable under instructions from the microprocessor 13.

All of the above processor 13 instructions are transferred between the microprocessor 13 and the sound interface circuit 11 via the data lines 21. A reset circuit 23 whose function is either operator initiated or clock initiated resets both the microprocessor 13 and the sound interface circuit 11 functions via the information line 25.

The sound interface circuit 11 receives instructions from operator and/or "player" controlled input paddles 27. This circuit 11 also receives auxiliary audio input 29 and provides audio output 31.

Figure 2:
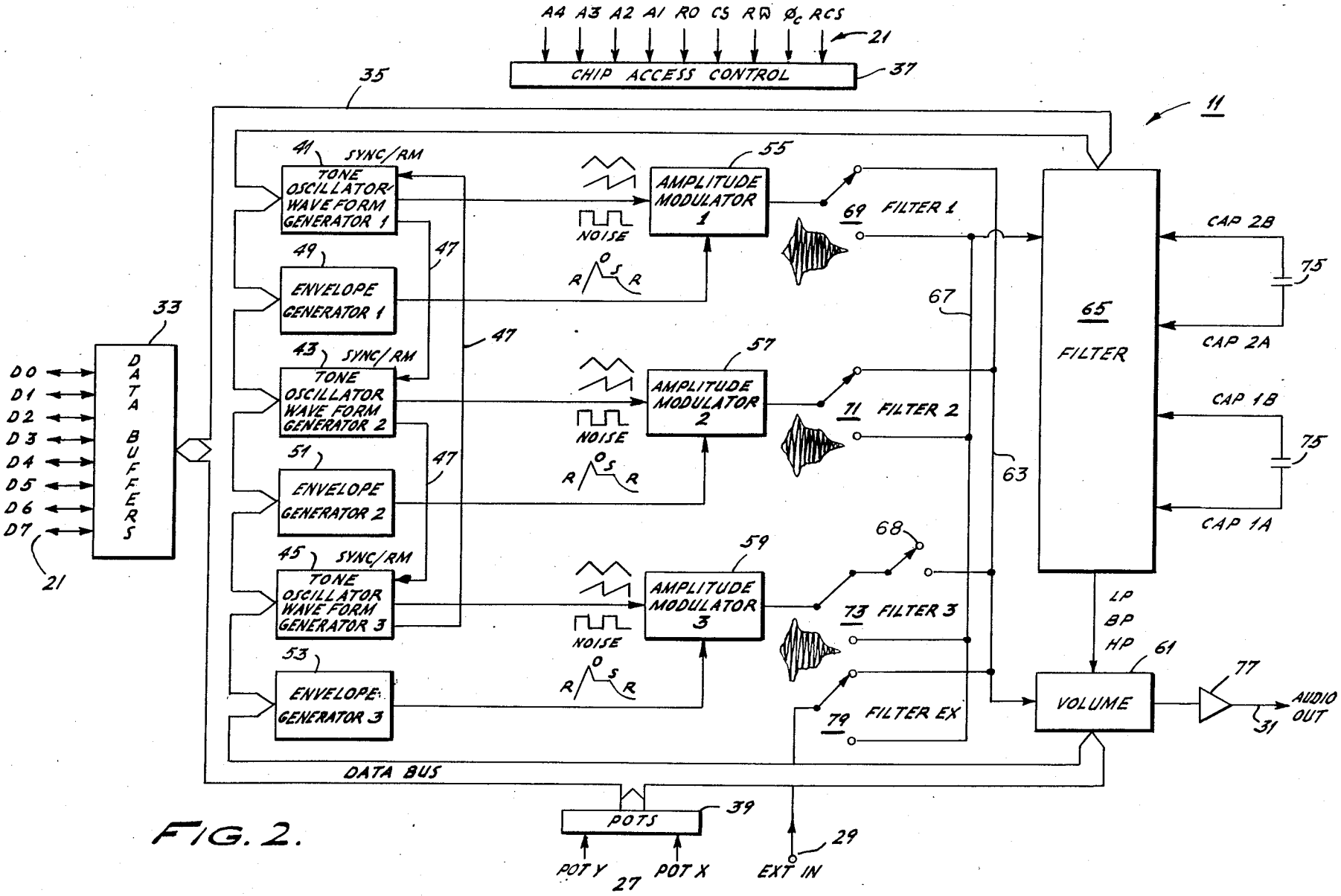
FIG. 2 is a block circuit diagram of the invention.

A circuit block diagram, FIG. 2, shows the sound interface circuit 11 of FIG. 1. Data buffers 33 receive the instructions via the data lines 21 from the microprocessor 13. These data buffers 33 feed a data bus 35 which is interconnected with each of the circuit subsystems of the sound interface circuit 11. Access information fed via other data lines 21 is provided to an access control circuit 37.

Operator instructions via operator paddles 27 is input to a plurality of potentiometers 39 which are connected to the data bus 35.

Three individual and independent tone oscillators 41, 43, and 45 each generate an independent waveform and are operated under instructions from the data bus 35. The tone oscillators 41, 43, 45 are interconnected via synchronization instruction lines 47.

Three discrete and independently operating envelope generators 49, 51, and 53 each receive individual instructions from the data bus 35 connection.

The first tone oscillator 41 and the first envelope generator 49 outputs are connected to a first amplitude modulator 55, while the second tone oscillator 43 and second envelope generator 51 outputs are connected to a second amplitude modulato 57 and the output of the third tone oscillator 45 and the third envelope generator 53 are connected to a third amplitude modulato 59 Each of the tone oscillators is independently capable of providing a square wave, saw tooth wave, triangular wave or white noise, while each envelope generator defines the attack rate, decay rate, sustain level and release rate of the "tone" or "voice" to be generated.

Each amplitude modulator 55, 57, 59, provides a "sound frequency" envelope which is either fed directly into a volume controller 61 via data line 63 or fed directly into a filter 65 via information line 67. This selection between information line 63 and 67 being selectively made individually or in unison by individual instruction word responsive switches 69, 71, 73, whereof switch 69 is connected on the output of amplitude modulator 55, switch 71 is connected on the output of amplitude modulator 57 and switch 73 is connected on the output of amplitude modulator 59. The switch 73 also has a disconnect position 68 so that the output of the third amplitude modulator 59 can be cut out of the system altogether.

Frequency range tuning capacitors 75 are connected to the filter 65. The output of the filter 65 is fed to the volume controller 61 whose output is fed through an amplifier 77 as the audio output 31.

The auxiliary audio input 29 can be selectably fed through the switch 79 to either the volume controller 61 or the filter 65.

The electronic circuitry which implements each of the elements described hereinabove in conjunction with FIG. 2 are program instruction controlled or program instruction checked or adjusted.

There are 29 eight-bit registers in the circuit 11 which control the generation of sound. These registers are either WRITE only or READ only and are listed below in Table 1.

TABLE 1

| Register No. | ADDRESS A4 | A3 | A2 | A1 | A0 | REG # (HLX) | DATA D7 Through D0 | REG NAME | REG TYPE |
|---|---|---|---|---|---|---|---|---|---|
| | | | | | | | | | VOICE 1 |
| 00 | 0 | 0 | 0 | 0 | 0 | 00 | | FREQ LO | WRITE-only |
| 01 | 0 | 0 | 0 | 0 | 1 | 01 | | FREQ HI | WRITE-only |
| 02 | 0 | 0 | 0 | 1 | 0 | 02 | | PW LO | WRITE-only |
| 03 | 0 | 0 | 0 | 1 | 1 | 03 | | PW HI | WRITE-only |
| 04 | 0 | 0 | 1 | 0 | 0 | 04 | | CONTROL REG | WRITE-only |
| 05 | 0 | 0 | 1 | 0 | 1 | 05 | | ATTACK/DECAY | WRITE-only |
| 06 | 0 | 0 | 1 | 1 | 0 | 06 | | SUSTAIN/RELEASE | WRITE-only |
| | | | | | | | | | VOICE 2 |
| 07 | 0 | 0 | 1 | 1 | 1 | 07 | | FREQ LO | WRITE-only |
| 08 | 0 | 1 | 0 | 0 | 0 | 08 | | FREQ HI | WRITE-only |
| 09 | 0 | 1 | 0 | 0 | 1 | 09 | | PW LO | WRITE-only |
| 10 | 0 | 1 | 0 | 1 | 0 | 0A | | PW HI | WRITE-only |
| 11 | 0 | 1 | 0 | 1 | 1 | 0B | | CONTROL REG | WRITE-only |
| 12 | 0 | 1 | 1 | 0 | 0 | 0C | | ATTACK/DECAY | WRITE-only |
| 13 | 0 | 1 | 1 | 0 | 1 | 0D | | SUSTAIN/RELEASE | WRITE-only |
| | | | | | | | | | VOICE 3 |
| 14 | 0 | 1 | 1 | 1 | 0 | 0E | | FREQ LO | WRITE-only |

TABLE 1-continued

| Register No. | ADDRESS A4 | A3 | A2 | A1 | A0 | REG # (HLX) | DATA D7 Through D0 | REG NAME | REG TYPE |
|---|---|---|---|---|---|---|---|---|---|
| 15 | 0 | 1 | 1 | 1 | 1 | 0F | | FREQ HI | WRITE-only |
| 16 | 1 | 0 | 0 | 0 | 0 | 10 | | PW LO | WRITE-only |
| 17 | 1 | 0 | 0 | 0 | 1 | 11 | | PW HI | WRITE-only |
| 18 | 1 | 0 | 0 | 1 | 0 | 12 | | CONTROL REG | WRITE-only |
| 19 | 1 | 0 | 0 | 1 | 1 | 13 | | ATTACK/DECAY | WRITE-only |
| 20 | 1 | 0 | 1 | 0 | 0 | 14 | | SUSTAIN/RELEASE | WRITE-only |
| | | | | | | | | | FILTER |
| 21 | 1 | 0 | 1 | 0 | 1 | 15 | | FC LO | WRITE-only |
| 22 | 1 | 0 | 1 | 1 | 0 | 16 | | FC HI | WRITE-only |
| 23 | 1 | 0 | 1 | 1 | 1 | 17 | | RES/FILT | WRITE-only |
| 24 | 1 | 1 | 0 | 0 | 0 | 18 | | MODE/VOL | WRITE-only |
| | | | | | | | | | MISC |
| 25 | 1 | 1 | 0 | 0 | 1 | 19 | | POTX | READ-only |
| 26 | 1 | 1 | 0 | 1 | 0 | 1A | | POTY | READ-only |
| 27 | 1 | 1 | 0 | 1 | 1 | 1B | | OSC3/RANDOM | READ-only |
| 28 | 1 | 1 | 1 | 0 | 0 | 1C | | ENV3 | READ-only |

The description of each register is as follows:

Voice 1

FREQ. LO/FREQ. HI (Registers 00,01):

Together these registers form a 16-bit number which linearly controls the frequency of oscillator 41. The frequency is determined by the following equation:

$$Fout=(Fn * Fclk/16777216)\ HZ$$

where Fn is the 16-bit number in the frequency registers and Fclk is the system clock. For a standard 1.8 Mhz clock, the frequency is given by:

$$Fout=(Fn * 0.0596)\ Hz$$

Frequency resolution is sufficient for any tuning scale and allows sweeping from note to note (portamento) with no discernable frequency steps.

PW LO/PW HI Registers 02,03:

Together these registers form a 12-bit number which linearly controls the pulse width (duty cycle) of the pulse waveform on oscillator 41. The pulse width is determined by the following equation:

$$PWout=(PWn/49.95)\%$$

Where PWn is the 12-bit number in the pulse width register. The pulse width resolution allows the width to be smoothly swept with no discernable stepping. The pulse waveform of oscillator 41 must be selected in order for the pulse width registers to have any audible effect. A value of 0 or 4095 in the pulse width registers will produce a constant DC output, while a value of 2048 will produce a square wave.

Control Register (Register 04);

This register contains eight control bits which select various options on oscillator 41:

Gate (Bit 0)—The gate bit controls the envelope generator for voice 1. When this bit is set to a one, the envelope generator 49 is gated (triggered) and the attack/decay/sustain cycle is initiated. When the bit is rest to a zero, the release cycle begins. The envelope generator 41 controls the amplitude of oscillator 41 appearing at the audio outlet of modulator 55. Therefore, the gate bit must be set (along with suitable envelope parameters) for the selected output of oscillator 41 to be audible.

SYNC (Bit 1)—The sync bit, when set to a one, synchronizes the fundamental frequency of oscillator 41 with the fundamental frequency of oscillator 45, producing "hard xync" effects. Varying the frequency of oscillator 41 with respect to oscillator 45 produces a wide range of complex harmonic structures from voice 1 at the frequency of oscillator 45. In order for synchronization to occur oscillator 45 must be set to some frequency other than zero but preferably lower than the frequency of oscillator 41. No other paraments of voice 3 have any effect on synchronization.

RING MOD (Bit 2) The ring mod bit, when set to a one, replaces the triangle waveform output of oscillator 41 with a "ring modulated" combination of oscillators 41 and 45. Varying the frequency of oscillator 1 with respect to oscillator 3 produces a wide range of non-harmonic overtone structures for creating bell or song sounds and for special effects. In order for ring modulation to be audible, the triangular waveform of oscillator 41 must be selected and oscillator 45 must be set to some frequency other than zero. No other parameters of voice 3 have any effect on ring modulation.

TEST (Bit 3)—The test bit, when set to a one, resets and locks oxcillator 41 at zero until the test bit is cleared. The noise waveform output of oscillator 41 is also reset and the pulse waveform output is held at a DC level. Normally this bit is used for testing purposes, however, it can be used to synchronize oscillator 41 to external events, allowing the generation of highly complex waveforms under real-time software control.

TRIANGULAR (Bit 4)—When set to a one, the triangular waveform output of oscillator 41 is selected. The triangular waveform is low in harmonics and has a mellow, flute-like quality.

SAWTOOTH (Bit 5)—When set to a one, the sawtooth waveform output of oscillator 41 is selected. The sawtooth waveform is rich in even and odd harmonics and has a bright, brassy quality.

SQUARE (Bit 6)—When set to a one, the pulse waveform output of oscillator 41 is selected. The harmonic content of this waveform can be adjusted by the pulse width registers, producing tone qualities ranging from a bright, hollow sqaure wave to a nasal, reedy pulse. Sweeping the pulse width in real time produces a dynamic "phasing" effect which adds a sense of motion to the sound. Rapidly jumping between the different pulse widths can produce interesting harmonic sequences.

NOISE (Bit 7)—When set to a one, the noise outlet waveform of oscillator 41 is selected. This output is a random signal which changes at the frequency of oscillator 41. The sound quality can be varied from a low rumbling to hissing white noise via the oscillator 41 frequency registers. Noise is useful in creating explosings, gunshots, jet engines, wind, surf and other unpitched sounds, as well as snare drums and cymbals. Sweeping the oscillator frequency with noise selected produces a dramatic rushing effect.

One of the output waveforms must be selected for oscillator 41 to be audible, however, it is not necessary to de-select waveforms to silence the output of voice 1. The amplitude of voice 1 at the final output is a function of the envelope generator 49 only.

Oscillator output waveforms are not additive. If more than one output waveform is selected simultaneously, the result will be a logical ANDing of the waveforms.

ATTACK/DECAY (Register 05): Bits 4–7 of this register select 1 of 16 attack rates for the voice 1 envelope generator 49. The attack rate determines how rapidly the output of voice 1 rises from zero to peak amplitude when the envelope generator 49 is gated.

Bits 0–3 of this register select 1 of 16 decay rates for the envelope generator 49. The decay cycle follows the attack cycle and the decay rate determines how rapidly the output falls from the peak amplitude to the selected sustain level.

SUSTAIN/RELEASE (Register 06): Bits 4–7 of this resistor select 1 of 16 sustain levels for the envelope generator 49. The sustain cycle follows the decay cycle and the output of voice 1 will remain at the selected sustain amplitude as long as the gate bit remains set. The sustain levels range from zero to peak amplitude in 16 linear steps, with a sustain value of 0 selecting zero amplitude and a sustain value of 15 (HF) selecting the peak amplitude. A sustain value of 0 would cause voice 1 to sustain at an amplitude one-half the peak amplitude reached by the attack cycle.

Bits 0–3 of the register select 1 of 16 release rates for the envelope generator 49. The release cycle follows the sustain cycle when the gate bit is reset to zero. At this time, the the output of voice 1 will fall from the sustain amplitude to zero amplitude at the selected release rate. The 16 release rates are identical to the decay rates.

The cycling of the envelope generator 49 can be altered at any point via the gate bit. The envelope generator 49 can be gated and released without restriction. If the gate bit is reset before the envelope has finished the attack cycle, the release cycle will immediately begin starting from whatever amplitude had been reached. If the envelope is then gated again (before the release cycle has reached zero amplitude), another attack cycle will begin starting from whatever amplitude had been reached. This technique can be used to generate complex amplitude envelopes via real time software control.

Registers 07 to 00 control the second oscillator 43 and the second envelope generators to provide voice z, and are identical to the structure and operation of the register 00 to 06 described above to control the first oscillator 41 and the first envelope generator 49 to provide voice 1, with the following exceptions:

When selected, the instruction initiates a SYNC synchronization of oscillator 43 with oscillator 41.

When selected the ring mod instruction replaces the triangle output of oscillator 43 with a "ring modulated" combination of oscillators 41 and 43.

Voice 3

Registers OE to 14 control the generation of Voice 3 via the control of oscillator 45 and envelope generator 53 and are functionally identical in structure and operation to registers 00–06 with these exceptions:

When selected the SYNC instruction initiates a synchronization of oscillator 45 with oscillator 43 via line 47.

When selected, the RING MOD instruction replaces the triangle output of oscillator 45 with the "ring modulated" combination of oscillators 43 and 45.

Typical operation of a voice consists of selecting the desired parameters: frequency, waveform,effects (SYNC, RING MOD) and envelope rates, then gating the voice whenever the sound is desired. The sound can be sustained for any length of time and terminated by clearing the gate bit. Each voice can be used separately, with independent parameters and gating, or in unison to create a single powerful voice. When used in unison a slight detuning of each oscillator or tuning to musical intervals creates a rich, animated sound.

Filter 65:

FC LO/FC HI (Registers 15 to 16)—Together these registers form an 11-bit number which linearly controls the cutoff (or center) frequency of the programmable filter 65. The approximate cutoff frequency is determined by the following equation:

$$FCout=((6.6E\text{-}8+FCn*1.28E\text{-}8)/C)\ Hz$$

Where FCn is the 11-bit number in the cutoff registers and C is the value of the two filter capacitors 75 connected to the filter 65. For the recommended capacitor value of 2200 pF, the approximate range of the filter 15 is 30 Hz–12 kHz according to the following equation:

$$FCout=(30+FCn*5.8)\ Hz$$

The frequency range of the filter 65 can be altered to suit specific applications.

RES/FILT (Register 17)—Bits 4–7 of this register (RESO,RES3) control the resonance of the filter 65. Resonance is a peaking effect which emphasizes frequency components at the cutoff frequency of the filter 65, causing a sharper sound. There are 16 resonance settings, ranging linearly from no resonance (0) to maximum resonance (15 or $F).

Bits 0–3 determine which signals from among Voice 1, 2 and 3 will be routed through the filter 65: via the switches 69, 71, 73 respectively.

FILT 1 (Bit 0)—When set to a zero. Voice 1 from modulator 55 appears directly at the audio output and the filter 65 has no effect on it. When set to a one, Voice 1 will be processed through the filter and the harmonic content of Voice 1 will be altered according to the selected Filter parameters.

FILT 2 (Bit 1)—Same as bit 0 for Voice 2.

FILT 3 (Bit 2)—Same as bit 0 for Voice 3.

FILTEX (Bit 3)—Same as bit 0 for external audio input.

MODE/VOL (Register 18)—Bits 4–7 of this register select various Filter mode and output options:

LP (Bit 4)—When set to a one, the "low pass" mode of the filter 65 is selected and sent to the audio output 31 via volume controller controller 61. For a given filter 65 input signal, all frequency components below the filter cutoff frequency are passed unaltered, while all frequency components above the cutoff are attenuated a a rate of 12 dB/octive. The "low pass" mode produces full-bodied sounds.

BP (Bit 5)—Same as bit 4 for the "band pass" mode. All frequency components above and below the cutoff are attenuated at a rate of 6 dB/octive. The band pass mode produces thin, open sounds.

HP (Bit 6)—Sume as bit 4 for the High Pass output. All frequency components above the cutoff are passed unaltered, while all frequency components below the Cutoff are attenuated at a rate of 12 dB/Octabe. The High Pass mode produces tinny, buzzy sounds.

3 OFF (Bit 7)—When set to a one, the output of modulator 59 i.e., Voice 3, disconnected from the direct audio path 63 to volume controller 61. Switching Voice 3 to bypass the filter 65 (FILT 3-0) and setting switch 73 to the "off" position prevents Voice 3 from reaching the audio output 31. This allows Voice 3 (modulator 59 output) to be used for modulation purposes without any undesirable output.

The filter 65 outputs are additive and multiple filter modes may be selected simultaneously. For example, both LP and HP modes can be selected to produce a "Notch" (or Band Reject) filter 65 response. In order for the filter 65 to have any audible effect, at least one filter output must be selected and at least one Voice must be routed through the Filter. The Filter is, perhaps, the most important element in register number 10 as it allows the generation of complex tone colors via subtractive synthesis (the Filter is used to eliminate specific frequency components from a harmonically-rich input signal). The best results are achieved by varying the Cutoff Frequency in realtime. Further discussion of the Filter appears in Appendix C.

Bits 0–3 (VOL0–VOL3) select 1 of 16 overall volume levels for the volume controller 61 providing the final composite audio output 31. The output volume 61 levels range from no output (0) to maximum volume (15 or OF) in 16 linear steps. This control can be used as a static volume control for balancing levels in multi-chip systems or for creating dynamic volume effects, such as tremolo.

POTX (Register 19)—Th1s register allows the microprocessor 13 to read the position of the potentiometer 39 tied to POTX signal 27. Values range from 0 at minimum resistance, to 255 (FF) at maximum resistance. The value is updated every 512 clock cycles.

POTY (Register 1A)—Same as POTX for the pot 29 tied to the POTY signal 27.

OSC/3 RANDOM (Register 18)—This register allows the microprocessor 11 to read the upper 8 output bits of oscillator 45. The character of the numbers generated is directly related to the waveform selected. If the "sawtooth" waveform of oscillator 45 is selected, this register will present a series of numbers incrementing from 0 to 255 (FF) at a rate determined by the frequency of oscillator 45. If the "triangle" waveform is selected, the output will increment from 0 up to 255, then decrement down to 0. If the pulse square waveform is selected, the output will jump between 0 and 255. Selecting the "noise" waveform will produce a series of random numbers, therefore, this register can be used as a random number generator for games. There are numerous timing and sequencing applications for the OSC 3 register, however, the chief function is probably that of a modulation generator. The numbers generated by this register can be added, via software, to the oscillator or filter frequency registers or the pulse width registers in real-time. Many dynamic effects can be generated in this matter. Siren-like sounds can be created by adding the OSC 3 sawtooth output to the frequency control of another oscillator. Synthesizer "sample and hold" effects can be produced by adding the OSC 3 "noise" output to the filter frequency control registers. Vibrato can be produced by setting oscillator 45 to a frequency around 7 Hz and adding the OSC 3 "triangle" output (with proper scaling) to the frequency control of another oscillator. An unlimited range of effects are available by altering the frequency of oscillator 45 and scaling the OSC 3 output. Normally, when oscillator 45 is used for modulation, the audio output of voice 3 should be eliminated (3 OFF=1).

ENV 3 (Register 10)—Sames as OSC 3, but this register allows the microprocessor 13 to read the output of the voice 3 envelope generator 53. This output can be added to the filter frequency to produce harmonic envelopes, and similar effects. "Phaser" sounds can be created by adding this output to the frequency control registers of an oscillator. The voice 3 envelope generator 53 must be gated in order to produce any output from this register. The OSC 3 register, however, always reflects the changing output of the oscillator 45 and is not affected in any way by the envelope generator 53.

FIG. 3 shows the timing diagram and symbol table for a "read cycle" operation of the sound interface circuit 11. FIG. 4 shows the timing diagram for a "write cycle" operation of the sound interface circuit 11.

Figure 5A:
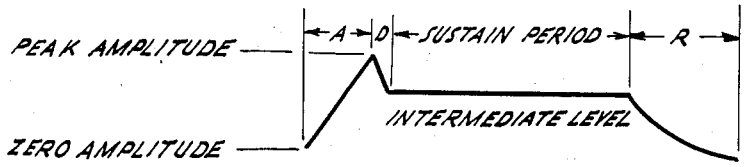
FIGS. 5 (*a*) and (*b*) show a response curve for a string instrument frequency response curve and that provided by the invention, respectively.
Figure 5B:
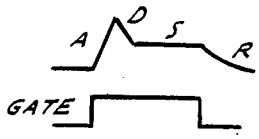

Each of the four-part ADSR (attack, decay, sustain, release) envelope generators 49, 51, 53 has been proven in electronic music to provide the optimum trade-off between flexibility and ease of amplitude control. Appropriate selection of envelope parameters allows the simulation of a wide range of percussion and sustained instruments. The violin is a good example of a sustained instrument. The violinist controls the volume by bowing the instrument. Typically, the volume builds slowly, reaches a peak, then drops to an intermediate level. The violinist can maintain this level for as long as desired, then the volume is allowed to slowly die away. A comparison of a type violin response curve, FIG. 5(*a*), is shown against the frequency response curve generated by the sound interface circuit 11, FIG. 5(*b*). The "tone" can be generated by the circuit 11 at the intermediate sustain level for as long as desired. The tone will not begin to die away until "Gate" is cleared. With minor alterations, this basic envelope can be used for brass and woodwinds as well as strings.

Figure 6A:
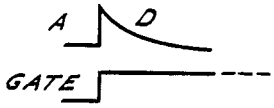
FIGS. 6 (*a*) and (*b*) show a frequency response curve for a percussion instrument and that provided by the invention, respectively.
Figure 6B:
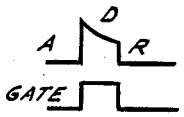

An entirely different form of envelope is produced by percussion instruments such as drums, cymbals and gongs, as well as certain keyboards such as pianos and harpsichords. The percussion envelope is characterized by a nearly instantaneous "attack", immediately followed by a "decay" to zero volume. Percussion instruments cannot be sustained at a constant amplitude. For example, the instant a drum is struck, the sound reaches full volume and decays rapidly regardless of how it was struck A typical cymbal frequency response envelope is represented in FIG. 6(*a*). A synthesized frequency response from the circuit 11 is represented in FIG. 6(*b*).

For the frequency response of FIG. 6(*a*) the tone immediately begins to decay to zero amplitude after the peak is reached. The circuit 11 can accurately synthesize this response regardless of when Gate is cleared. The amplitude envelope pianos and harpsichords is somewhat more complicated, but can be generated. These instruments reach full volume when a key is first struck. The amplitude immediately begins to die away slowly as long as the key remains depressed. If the key is released before the sound has fully died away, the amplitude will immcdiately drop to zero. These typical synthesized frequency responses are shown as FIG. 6(*b*).

Figure 7A:
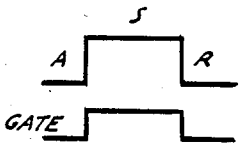
FIGS. 7(*a*) and (*b*) show a frequency response curve for an organ and that provided by the invention, and a unique synthesized sound, respectively.
Figure 7B:
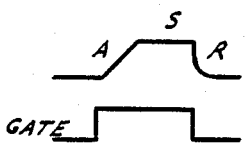

The most simple envelope is that of the organ. When a key is pressed, the tone immediately reaches full volume and remains there When the key is released, the tone drops immediately to zero volume. The frequency response curve for a typical organ zero volume. The frequency response curve for a typical organ "note" is shown as FIG. 7(*a*). The circuit 11 can accurately synthesize this frequency response. As synthesized the tone decays slowly until "Gate" is cleared, at which point the amplitude drops rapidly to zero.

The circuit 11 has the ability to create original sounds rather than simulations of acoustic instruments. The circuit 11 is capable of creating envelopes which do not correspond to any "real" instruments. A good example would be the "backwards" envelope, whihc is characterized by a slow attack and rapid decay, which sounds very much like an instrument that has been recorded on tape then played backwards. This frequency response envelope is shown as FIG. 7(*b*).

Many unique sounds can be created by applying the amplitude envelope of one "instrument" to the harmonic structure of another. This produces sounds similar to familiar acoustic instruments, yet notably different. In general, sound is quite subjective and experimentaion with various envelope rates and harmonic contents will be necessary in order to achieve the desired sound.

The circuit elements of the sound interface circuit 11 shown in block diagram representation as FIG. 2, can be implemented using various hardware structures. Whether implemented as discrete components or as a monolithic large scale integrated circuit, these circuit elements are implemented using known structural elements and design concepts such as capacitors, field effect transistors (FET) registers, transistor gates and so forth.

Data buffers 33 are shown in greater detail in FIG. 8. Oscillator 101 feeds pulse frequency signals to a read-write cycle generator 103 which receives information from the microprocessor 13 via the data bus 35. The output from the read-write cycle generator is fed to an address buffer 105 which in turn feeds an address decoder 107 to provide an instruction word 109, which when the circuit 11 is an 8-bit machine is transferred over the 8 data lines 109.

The potentiometer interface 39 of FIG. 2 is implemented as shown in FIG. 9. The analog input 27 from the player control potentiometer is fed to an analog digital converter 111 which in turn feeds a counter 113. The counter 113 feeds a latched register 115 which has an 8 bit output 109(*a*).

The amplitude modulator 55 can be further implemented as shown in FIG. 10. Control logic 117 receives the output signal from the envelope generator 119 and the output signal from the shaper 121 and provides control pulses to a modulator 123 which is driven by the oscillator 101. The control logic 117 also provides control instructions to an up-down counter 125 which in turn feeds information to the modulator 123. The output of the modulator 123 is connected to a digital analog converter 127 which in turn provides the output 129 from the modulator 55. Up-down counter 125 also feeds a sustained comparator 131 which is connected to a divider 133. The divider 133 provides a divide by 1, divide by 30, divide by 16, divide by 4 and divide by 2 signals to the control logic 117.

The switch 69 of FIG. 2 is implemented as shown in FIG. 11. Here a pair of FETs 135 and 137 implement the switch. These FETs 135, 137 each receive the modulator output 129 on their source pin and provide separate and independent outputs 139, 141, respectively, which are mutually exclusive through the cross-coupling of the FET 135, 137. The FET 135 or 137 is switched to conduction through an instruction signal 142.

Figure 12:
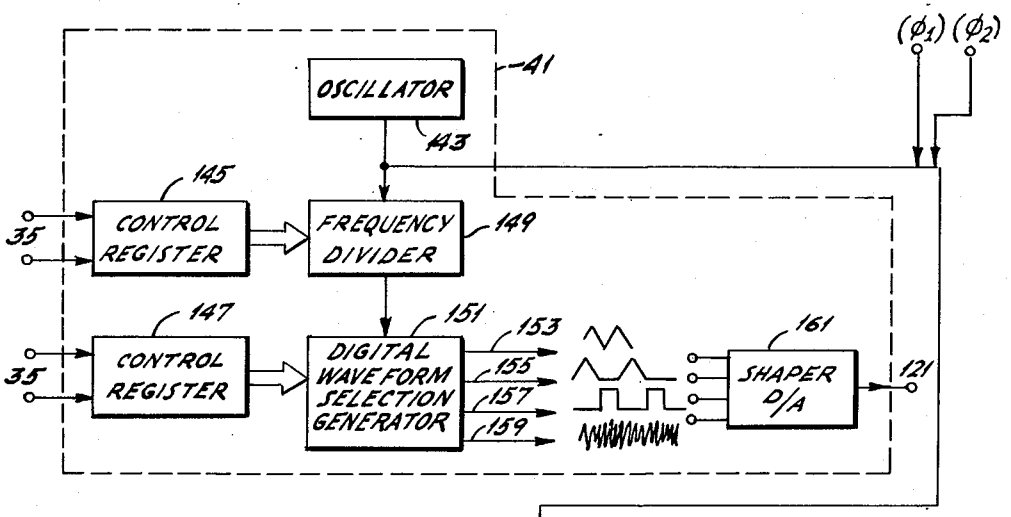
FIG. 12 is a block circuit diagram for the tone oscillator 41 of FIG. 2.

The tone oscillator 41 which provides the waveform generation function, FIG. 12, includes an individual and dedicated oscillator 143. Instruction words from the data bus 35 are input into a first control register 145 and a separate second control register 147. The first control register 145 is connected to and controls a frequency divider 149. The frequency divider 149 feeds a digital waveform select generator 151 which generates any of the four desired waveforms (sawtooth 153, triangular 155, square 157, and noise 159). Each of the waveforms generated by the generator 151 is fed via an individual line to the shaper digital to analog converter 161 which provides the analog representation of the waveform as output 121. The waveforms 153, 155, 157, 159, are provided by the generator 151 on a mutually exclusive basis under the control of the control register 147.

Figure 13:
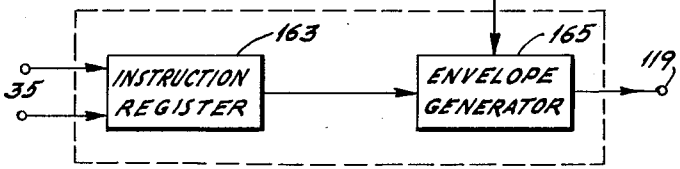
FIG. 13 is a block circuit diagram for the envelope generator 49 of FIG. 2.
Figure 14:
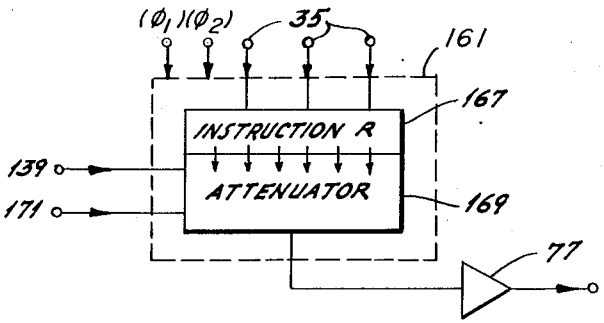
FIG. 14 is a block circuit diagram for the volume controller 61 of FIG. 2.

Envelope generator 49 is shown in greater detail as FIG. 13. An instruction register 163 recives information from the data bus 35 and controls the operation of an envelope generator 165 which is driven from the oscillator 143 to provide the output 119.

The volume controller 161 is implemented as an instruction register 167 which controls the operation of an attenuator 169 to provide an output to the amplifier 77. The instruction register 167 receives instructions from the data bus 35 while the attenuator receives an input signal from digital filter 65 output 171 or from the output 139 of the switch 69.

Figure 15:
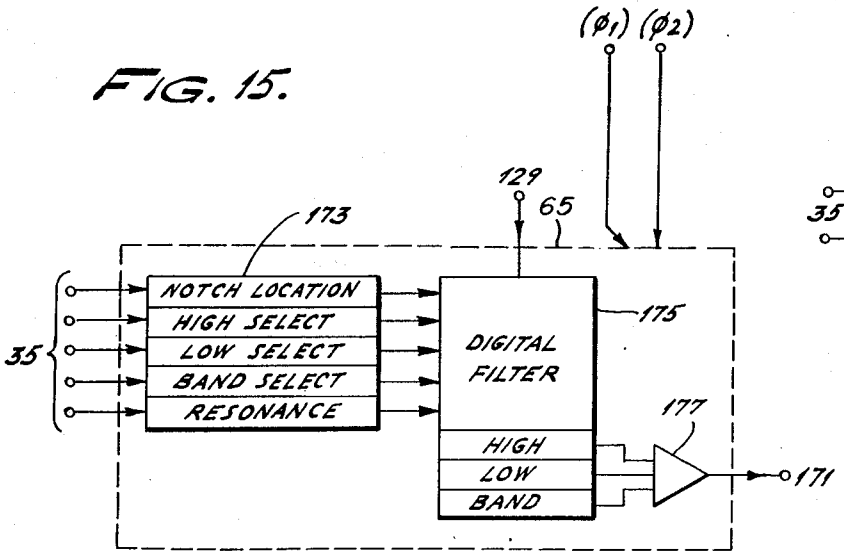
FIG. 15 is a block circuit diagram for the filter 65 of FIG. 2.

The filter 65 is implemented as shown in FIG. 15. A register 173 holds notch location information, high pass filter selection instructions, low pass filter selection instructions, band pass filter selection instructions and resonance frequency selection instruction which are received from the data bus 35. This register 173 sets a digital filter 175 which processes the analog output of the modulator 155 by a connection to its digital to analog converter 127 output 129. The output from the digital filter which either performs high pass, low pass or band pass functions on a mutually exclusive basis is gated by a gate 177 together to provide the output 171 which is fed to the attenuator 169.

Two non-overlapping clock pulses, the first clock pulse being designated ($\Phi 1$) and the second clock pulse being designated ($\Phi 2$) provide two operational periods for all of the circuitry described above in connection with FIGS. 8 through 15. The first clock pulse ($\Phi 1$) period allows for a transfer of information and conditioning of the circuitry. The second clock pulse ($\Phi 2$) establishes the logical operation or processing time period.

The description of the circuitry above in regards to FIGS. 8–14 also provides a description of the circuitry for the oscillators 43, 45, envelope generators 51, 53, modulators 57,59 and switches 71,73,79.

The above description of the invention is intended to be illustrative and is not intended to be taken in the limiting sense. Changes and modifications can be made without departing from the intent and scope thereof.

What is claimed is:

1. A sound interface circuit for selectively generating a plurality of voices, for use in a home video game circuit, said name circuit having a programmable microprocessor holding digital instruction signals, analog game player inputs and providing a first and second non-overlapping clock pulses, comprising:

data buffer circuit means for receiving said miroprocessor instruction signals for providing control instructions;

a data bus connected to said buffer means for carrying said control instructions connected from said data buffer means;

a means connected to said analog game play inputs for analog to digital transformation of each said analog player input to digital player instructions, said player instructions being fed to said data bus;

a first, second and third tone oscillator circuit means, each individually operated and independently structured, for each providing a separate tone frequency according to a digital instruction signals from said data bus;

a first, second and third envelope generator circuit means each individually operated and independently structured for each providing a frequency envelope format according to a digital instruction signals from said data bus;

a first, second and third amplitude modulator circuit means, each independently structured for each providing an amplitude modulated signal, said first modulator circuit means being connected to said first tone oscillator circuit means and said first envelope generator circuit means, said second modulator circuit means being connected to said second tone oscillator circuit means and said second envelope generator circuit means, said third modulator circuit means being connected to said third tone oscillator circuit means and said third envelope generator means;

a digital filter circuit means for shaping a signal, said digital filter circuit means operating according to digital instruction signals from said data bus and being connected thereto;

a volume controller connected on said digital filter signals circuit means output and operative according to a digital instruction from said data bus; and being connected thereto; and switch circuit means for selectively interconnecting any of said first, second and third amplitude modulator circuit means outputs with said digital filter means.

2. The circuit of claim 1 wherein said switch circuit means also selectively interconnects any of said first, second and third amplitude circuit means outputs with said volume controller.

3. The circuit of claim 2 wherein said switch circuit means also selectively interconnects said game player analog to digital transformer means to said digital filter circuit means and said volume controller.

4. The circuit of claim 3 wherein said data buffer circuit means comprises:

an oscillator;

a read/write cycle generator connected to said oscillator and said microprocessor instruction signals;

an address buffer connected to said read/write cycle generator; and an address decoder connected to said address buffer and to said data bus on its output.

5. The circuit of claim 4 wherein said analog transformer means includes:

an A/D converter connected to said a said analog player input;

a counter connected to said A/D converter output; and a latched register connected to said counter output, said latched register output being connected to said data bus.

6. The circuit of claim 5 wherein each said first, second and third tone oscillator means include structure as follows:

a first control register connected to said data bus;

a second control register connected to said data bus;

a first dedicated oscillator;

a frequency divider connected to said first dedicated oscillator and said first control register output;

a digital wave form selection generator connected to said second control register output and said frequency divider output, said selection generator providing an output being either a triangular wave, a square wave or white nosie; and a signal shaper connected to the outputs of said wave form selection generator.

7. The circuit of claim 6 wherein said digital filter circuit means includes:

a first register for holding notch location, high select, low select, band select and reasonance instruction signals, said first register having its input connected to said data bus;

a digital filter connected to said first register output and to said first modulator, this digital filter having a high pass, low pass and band pass outputs; and a gate connected to said high pass, said low pass and said band pass outputs to gate said signals through on an exclusive basis.

8. The circuit of claim 7 wherein each said first second and third modulator circuit means include structure as follows:

a control logic circuit having an input connection from a respective envelope generator;

a modulator connected to said control logic circuit output said modulator having an input connection from said oscillator;

an up-down counter connected to said control logic circuit output, said up-down counter having an output to said modulator;

a D/A converter connected to said modulator out put;

a sustain comparator connected to said up-down counter output; and a divider connected to said sustain comparator output, said divider output being connected back to said control logic circuit.

* * * * *